United States Patent [19]

Oehr

[11] 4,313,804

[45] Feb. 2, 1982

[54] PROCESS FOR PREPARING CERIC SULPHATE

[75] Inventor: Klaus H. Oehr, Surrey, Canada

[73] Assignee: B.C. Reasearch Council, Vancouver, Canada

[21] Appl. No.: 199,351

[22] Filed: Oct. 21, 1980

[51] Int. Cl.[3] ..... C25B 1/22
[52] U.S. Cl. ..... 204/93
[58] Field of Search ..... 204/93

[56] References Cited

U.S. PATENT DOCUMENTS 1,707,450 4/1929 Sommer ..... 204/93

OTHER PUBLICATIONS

Ramaswamy et al., Bull. Chem. Soc. (Japan), v. 35, (1962), pp. 1751–1755.

Culbertson et al., The Electrochemical Soc. (Apr. 20, 1942), pp. 27–32.

*Primary Examiner*—Howard S. Williams

*Attorney, Agent, or Firm*—Smyth, Pavitt, Siegemund & Martella

[57] ABSTRACT

A process for preparing ceric sulphate in solution. A saturated solution of cerous sulphate is electrolyzed at high anodic current density, high cathode current density and with vigorous agitation in the presence of dilute sulphuric acid. The process permits the production of concentrated ceric sulphate solutions at commercially viable current densities and efficiencies.

8 Claims, No Drawings

PROCESS FOR PREPARING CERIC SULPHATE

FIELD OF THE INVENTION

This invention relates to a process for preparing ceric sulphate.

DESCRIPTION OF THE PRIOR ART

The use of cerium oxidants, for example ceric sulphate, is well known in organic chemistry. Ceric sulphate can be used to prepare naphthoquinone from naphthalene, p-tolualdehyde from p-xylene and benzaldehyde from toluene.

In preparing a cerium oxidant for use in organic synthesis it is important to prepare the oxidant in as concentrated a form as possible. This is necessary to increase reaction rates and reduce reactor size requirements and manufacturing costs.

Kuhn in the Electrochemistry of Lead published by the Academic Press in 1979, summarizes the prior art in the oxidation of cerium (III) to cerium (IV). It is indicated that prior workers such as Ramaswamy et al, Bull. Chem. Soc. Jap. 35, 1751 (1962), and Ishino et al, Technol. Rep., Osaka University, 10, 261 (1960), have observed that the current efficiency for ceric sulphate production decreases with increasing concentration of sulphuric acid, for example 0.26 to 2.6 molar, and with increasing current density, for example 1 to 3.0 amps/dm$^2$, i.e. 10 to 30 mamp/cm$^2$. The current efficiency of ceric sulphate production was only 54% at an anode current density of 1 amp/dm$^2$ (10 mamp/cm$^2$). The "effective" anode current density was therefore only 5.4 mamp/cm$^2$. Ishino et al. found the best electrolysis conditions to be low anodic current density, for example 2 Amp/dm$^2$ (i.e. 20 mamp/cm$^2$), and low sulphuric acid concentration, for example, 0.43 M sulphuric acid.

The prior art fails to reveal how ceric sulphate can be prepared in a concentrated form and at commercially viable current densities, for example 100 mamp/cm$^2$, and commercially viable current efficiencies, for example 50%, to give "effective" anode current densities of 50 mamp/cm$^2$ or higher.

Kuhn, in the above publication, specifically indicates that little information is available for the reaction of oxidizing cerium (III) to cerium (IV).

SUMMARY OF THE INVENTION

However, the present application describes a process able to achieve extremely high current efficiencies for concentrated ceric sulphate preparation and very high effective anode current densities using a wide variety of anodes and cathodes and acid strengths deemed detrimental by others, specifically Ramaswamy et al and Ishino et al.

More specifically, the present invention is a process for preparing ceric sulphate in solution that comprises electrolyzing an at least saturated solution of cerous sulphate at high anodic current density, high cathode current density and with vigorous agitation in the presence of dilute sulphuric acid, for example one to two molar.

The saturated cerous sulphate may be maintained as such by electrolyzing a suspension of cerous sulphate, or by carrying out the electrolysis of a saturated cerous sulphate solution. A diaphragm is not used. The electrolysis of a saturated cerous sulphate solution is carried out briefly then the electrolyte is mixed with cerous sulphate crystals to resaturate it with respect to cerous sulphate. Undissolved cerous sulphate crystals are allowed to precipitate. The supernatant liquid is then re-electrolyzed.

DESCRIPTION OF THE PREFERRED EMBODIMENTS

The invention is illustrated in the following examples:

EXAMPLES

Except where indicated otherwise in Table 1 electrolysis of a starting electrolyte comprising 25 grams of cerous sulphate pentahydrate, 5.5 ml of concentrated sulphuric acid diluted to a volume of 100 ml with water to give 1 M sulphuric acid was carried out with vigorous agitation of the electrolyte during electrolysis. The results and reaction conditions are set out in Table 1. A diaphragm was not used in the electrolysis.

TABLE 1

PREPARATION OF CERIC SULPHATE OXIDANTS

| Anode | Anode Current Density (mamp/cm$^2$) | Cathode | Cathode Current Density (mamp/cm$^2$) | Anode Io Cathode Surface Area | Final Ceric Sulphate Concentration | Temperature | Current Efficiency | "Effective" Anode Current Density (mamp/cm$^2$) |
|---|---|---|---|---|---|---|---|---|
| Platinum | 100 | Lead | 2000 | 20:1 | 0.382M | 35–45° C. | 95.0 | 95.0 |
| Lead (anodized) | 100 | Tungsten | 2000 | 20:1 | 0.560M | 57–58° C. | 93.3 | 93.3 |
| Lead (anodized) | 200 | Tungsten | 2000 | 10:1 | 0.495M | 64–65° C. | 69.4 | 138.9 |
| Platinum | 200 | 316 Stainless Steel | 2000 | 10:1 | 0.58M* | 58–67° C. | 70.6 | 141.2 |
| Platinum | 100 | Tungsten | 1770 | 17.7:1 | 0.56M* | 99–63° C. | 94.1 | 94.1 |
| Platinum | 100 | Platinum | 1770 | 17.7:1 | 0.354M | 25° C. | 94.8 | 94.8 |
| Platinum | 100 | Platium | 1770 | 17.7:1 | 0.525M | 60–62° C. | 91.6 | 91.6 |
| Electroplated Lead Dioxide | 200 | Tungsten | 2000 | 10:1 | 0.504M | 33–36° C. | 51.2 | 102.4 |
| Electroplated Lead Dioxide | 100 | Tungsten | 2000 | 20:1 | 0.485M | 30–33° C. | 86.2 | 86.2 |
| Electroplated Lead Dioxide | 100 | Tungsten | 2000 | 20:1 | 0.342M** | 33° C. | 58.9 | 58.9 |

*Includes undissolved ceric sulphate i.e. electrolyte is supersaturated with ceric sulphate.
**Electrolyte is 2.0M $H_2SO_4$ instead of 1.0M $H_2SO_4$.

In addition to the above experiments illustrating the present invention experiments were carried out to attempt to reproduce the results of Ramaswamy et al, referred to above, by using an anodized lead anode and a lead cathode at current densities of 20 mamp/cm$^2$ and 300 mamp/cm$^2$ respectively using the electrolyte, electrolysis cell and electrolyte agitation defined in Table 1 above. Table 2 below summarizes the current efficiencies obtained during this experiment as a function of ceric ion concentration of the electrolyte.

TABLE 2

| Electrolysis Time (min.) | 209 | 272 | 309 | 367 | 402 | 426 | 485.5 |
|---|---|---|---|---|---|---|---|
| Anode Current Efficiency between adjacent times | 97.4% | 91.8% | 56.2% | 53.0% | 43.9 | 37.7 | 0 |
| Anode Current Efficiency cumulative | 97.4% | 96.0% | 91.1% | 85.2 | 81.5 | 79.1 | 69.2 |
| Ceric Sulphate Molarity | 0.225M | 0.289M | 0.312M | 0.346 | 0.363 | 0.373 | 0.372 |

The results show that applicant was unable to generate ceric sulphate above 0.37 m concentration by operating at a low anodic current density, that is 20 mamp/cm$^2$, and a low cathode current density of 300 mamp/cm$^2$ using Ramaswamy et al's suggested electrolysis conditions. Further, once the ceric sulphate concentration approaches 0.3 molar the anodic current efficiency began to drop rapidly. Inspection of the lead cathode used in this electrolysis revealed that it was covered with a thick deposit of lead. This deposition has not been observed during the high current density electrolysis described in Table 1 and has the following significance:

1. The fact that lead is plated on the cathode indicates that the lead dioxide film on the anodized lead anode is not stable during low current density electrolysis once the ceric ion concentration of the electrolyte builds up much above 0.3 molar concentration.

2. If the anode is unstable, current is being wasted in the following possible ways:

(a) Ceric ion in the electrolyte decomposes by reacting with lead atoms to form lead (11) ions which migrate to the cathode and plate out.

i.e.

$2Ce^{4+} + Pb^0 \rightarrow 2Ce^{3+} + Pb^2$ (anode)

$Pb^{2+} + 2e^- \rightarrow Pb^0$ (cathode)

The overall reaction is:

$2Ce^{4+} + 2e^- \rightarrow 2Ce^{3+}$ (b) The lead dioxide film produced by anodizing the lead electrode is not sufficiently polarized at low current densities to prevent its being decomposed by sulphuric acid to form lead sulphate.

i.e.

$PbO_2 + H_2SO_4 + 2H^+ + 2e^- \rightarrow PbSO_4 + 2H_2O$

If the lead dioxide ($PbO_2$) film is lost in whole or part, the anode is incapable of generating ceric sulphate and the underlying lead is susceptible to attack by ceric sulphate generated previously.

3. If lead electrodeposits on the cathode, the cathode current density is reduced and ceric sulphate decomposition is enhanced according to the following reaction:

$Ce^{4+} + 1e^- \rightarrow Ce^{3+}$

All three factors alone or in combination can have a disastrous effect on current efficiency for ceric ion production as is evident from Table 2.

The above problems can be avoided if a platinum anode is used instead of the lead dioxide anode used in Table 2. However, the use of platinum at low current densities of 20 mamp/cm$^2$ is too expensive.

Thus the present invention has illustrated that high current efficiencies obtained at high "effective" current densities and high ceric sulphate concentration when electrolysis is carried out at high anodic and cathodic current densities. It is important to maintain the maximum dissolved cerous ion concentration in the electrolyte for the entire electrolysis.

I claim:

1. A process for preparing ceric sulphate in solution that comprises electrolyzing an at least saturated solution of cerous sulphate at an anodic current density in the range 100 to 200 mamp/cm$^2$, high cathode current density and with vigorous agitation in the presence of dilute sulphuric acid.

2. A process as claimed in claim 1 in which the cerous sulphate is electrolyzed as a suspension.

3. A process as claimed in claim 1 in which the cerous sulphate is electrolyzed as a saturated cerous sulphate solution, mixed with cerous sulphate crystals to resaturate it with respect to cerous sulphate after brief electrolysis, allowing undissolved cerous sulphate crystals to precipitate and electrolyzing the supernatant, saturated cerous sulphate.

4. A process as claimed in claim 1 in which the cathodic current density is in the range 1500 to 2000 mamp/cm$^2$.

5. A process as claimed in claim 1 in which the electrolyte temperature is in the range of 25° C. to 67° C.

6. A process as claimed in claim 1 in which the anode used in the electrolysis is selected from electroplated lead dioxide, platinum and anodized lead.

7. A process as claimed in claim 1 in which the dilute sulphuric acid is one to two molar.

8. A process for preparing ceric sulphate in solution that comprises electrolyzing an at least saturated solution of cerous sulphate at high anodic current density, a cathodic current density in the range 1500 to 2000 mamp/cm$^2$ and with vigorous agitation in the presence of dilute sulphuric acid.

* * * * *